US009516936B2

(12) United States Patent
Lee et al.

(10) Patent No.: US 9,516,936 B2
(45) **Date of Patent: *Dec. 13, 2016**

(54) ORAL KIT INCLUDING VISIBLE STICKER PANEL

(75) Inventors: David K. Lee, East Brunswick, NJ (US); Quang Nguyen, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 53 days.

This patent is subject to a terminal disclaimer.

(21) Appl. No.: 14/006,718

(22) PCT Filed: Apr. 8, 2011

(86) PCT No.: PCT/US2011/031670

§ 371 (c)(1),
(2), (4) Date: Sep. 23, 2013

(87) PCT Pub. No.: WO2012/138346

PCT Pub. Date: Oct. 11, 2012

(65) Prior Publication Data

US 2014/0008266 A1 Jan. 9, 2014

(51) Int. Cl.
*A46B 15/00* (2006.01)
*A46B 17/00* (2006.01)
(Continued)

(52) U.S. Cl.
CPC ..... *A45C 11/00* (2013.01); *A46B 15/0085* (2013.01); *B65D 75/368* (2013.01); *B65D 75/54* (2013.01); *B65D 2203/02* (2013.01)

(58) Field of Classification Search
CPC ... B65D 75/368; B65D 75/54; B65D 2203/02; A45C 11/00; A46B 15/0085; A46B 15/0087; A46B 15/0091
(Continued)

(56) References Cited

U.S. PATENT DOCUMENTS 2,673,680 A 3/1954 Deutschmeister et al.
3,220,543 A * 11/1965 McCord et al. ..... 206/362.2
(Continued)

FOREIGN PATENT DOCUMENTS

CN 2642692 Y 9/2004
CN 1638702 7/2005
(Continued)

OTHER PUBLICATIONS

International Search Report and the Written Opinion of the International Searching Authority issued in International Application No. PCT/US2011/031670 mailed Dec. 16, 2011.
(Continued)

*Primary Examiner* — Chun Cheung

(57) ABSTRACT

An oral care kit (1000) including an oral care product (200) and a sticker panel (300). In one aspect, the invention may be an oral care kit (1000) comprising: a package (100); a toothbrush (200) disposed within the package (100); and a sticker panel (300) disposed within the package (100), the sticker panel (300) comprising a plurality of detachable stickers (301), the sticker panel (300) forming a sleeve through which a portion of the toothbrush (200) extends, the plurality of stickers (301) visible from outside of the package (100) through a substantially transparent portion of the package (100).

29 Claims, 6 Drawing Sheets

(51) Int. Cl.

| | |
|---|---|
| ***A45D 44/18*** | (2006.01) |
| ***A45C 11/00*** | (2006.01) |
| ***B65D 75/36*** | (2006.01) |
| ***B65D 75/54*** | (2006.01) |

(58) Field of Classification Search
USPC ..... 206/461–471, 361, 209, 581, 497
See application file for complete search history.

(56) References Cited

U.S. PATENT DOCUMENTS

| | | | | |
|---|---|---|---|---|
| 3,698,551 | A | 10/1972 | Tomlinson | |
| 3,730,335 | A * | 5/1973 | Tarrson | B65D 5/5007 206/362.2 |
| 4,261,462 | A * | 4/1981 | Wysocki | 206/463 |
| 4,824,143 | A | 4/1989 | Grainger | |
| 5,209,354 | A | 5/1993 | Thornhill et al. | |
| 5,485,919 | A | 1/1996 | Samberg et al. | |
| 6,170,663 | B1 * | 1/2001 | Glassman | 206/461 |
| 6,230,964 | B1 | 5/2001 | Saito | |
| 6,311,837 | B1 * | 11/2001 | Blaustein | B65D 75/36 206/362.2 |
| 6,321,944 | B1 * | 11/2001 | Cetrangolo | 206/459.5 |
| 6,766,906 | B2 * | 7/2004 | Charng | 206/470 |
| 7,246,709 | B2 | 7/2007 | Kim | |
| 7,356,866 | B2 | 4/2008 | Chan | |
| 2001/0032796 | A1 | 10/2001 | Rubenstein | |
| 2003/0166373 | A1 | 9/2003 | Whitney et al. | |
| 2003/0226223 | A1 | 12/2003 | Chan | |
| 2005/0044646 | A1 | 3/2005 | Peretz et al. | |
| 2007/0125679 | A1 | 6/2007 | Smith | |
| 2009/0313801 | A1 | 12/2009 | Jimenez et al. | |
| 2011/0125677 | A1 * | 5/2011 | Edelstein et al. | 206/361 |

FOREIGN PATENT DOCUMENTS

| | | | |
|---|---|---|---|
| CN | 201362453 | Y | 12/2009 |
| EP | 0683995 | A1 | 11/1995 |
| WO | WO2009/116997 | | 9/2009 |
| WO | WO2012087452 | | 6/2012 |

OTHER PUBLICATIONS

First Office Action mailed Aug. 13, 2014 in corresponding CA Application No. 2,832,274. CA.
First Office Action mailed Sep. 22, 2014 in corresponding CN Application No. 201180069922.2. CN.
Office Action mailed Sep. 30, 2014 in corresponding CO Application No. 13-236137. CO.
Office action mailed Sep. 24, 2014 in corresponding KR Application No. 2014-059884780. KR.
Corresponding Chinese Office Action issued on Feb. 22, 2016.
Corresponding Office Action from the EPO issued on Mar. 17, 2016.

* cited by examiner

ORAL KIT INCLUDING VISIBLE STICKER PANEL

CROSS-REFERENCE TO RELATED PATENT APPLICATIONS

The present application is a U.S. national stage application under 35 U.S.C. §371 of PCT Application No. PCT/US2011/031670, filed Apr. 8, 2011. The disclosure of the above application is incorporated herein by reference.

FIELD OF THE INVENTION

The present invention relates generally to the field of oral care kits, and specifically to oral care kits that include a package in which an oral care product and a sticker panel are disposed.

BACKGROUND OF THE INVENTION

In the oral care industry, efforts continue to be made to make oral care regiments more appealing, especially to children, who often find oral care boring and tedious. For example, toothbrushes have been developed that are intended to amuse the user through graphics, interactive games and/or light shows. Oral care kits have also been proposed in which a toothbrush and stickers are provided. The stickers are intended to be positioned on the included toothbrush (or other surface) as a reward for conducting the required oral care regiment. In one such existing kit, the toothbrush and stickers are located within a package so that the stickers themselves are not visible to a potential customer. Such an arrangement is undesirable because the existence of the stickers must be communicated to the consumer via other means. Moreover, consumers may not evaluate the quality and/or aesthetics of the stickers in the kit at the point of purchase.

BRIEF SUMMARY OF THE INVENTION

The present invention is directed to an oral care kit comprising a package having an oral care product and a sticker panel disposed therein. The sticker panel comprises a plurality of detachable stickers and is arranged within the package so that the stickers are visible through a transparent portion of the package. In certain embodiments, the oral care product is a toothbrush but may be other oral care products in certain other embodiments, such as a tongue cleaner, an interdental device, a tube of dentifrice, and/or combinations thereof.

In one embodiment, the invention may be an oral care kit comprising: a package; a toothbrush disposed within the package; and a sticker panel disposed within the package, the sticker panel comprising one or more stickers, the sticker panel forming a sleeve through which a portion of the toothbrush extends, at least one of the one or more stickers visible from outside of the package through a substantially transparent portion of the package.

In another embodiment, the invention may be an oral care kit comprising: a blister package comprising a substantially transparent three-dimensional front cover forming a receiving cavity; a toothbrush at least partially disposed within the receiving cavity; and a sticker panel at least partially disposed within the receiving cavity, the sticker panel comprising a plurality of detachable stickers, the sticker panel comprising a plurality of panel sections separated from one another by a seam and being non-coplanar with respect to one another, and wherein a front surface of at least one of the panel sections is visible through the three-dimensional front cover, at least one front surface of the plurality of panel sections comprising at least one sticker.

In yet another embodiment, the invention may be an oral care kit comprising: a package; an oral care product disposed within the package; and a sticker panel disposed within the package, the sticker panel comprising a plurality of detachable stickers, the plurality of stickers visible from outside of the package through a substantially transparent portion of the package.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
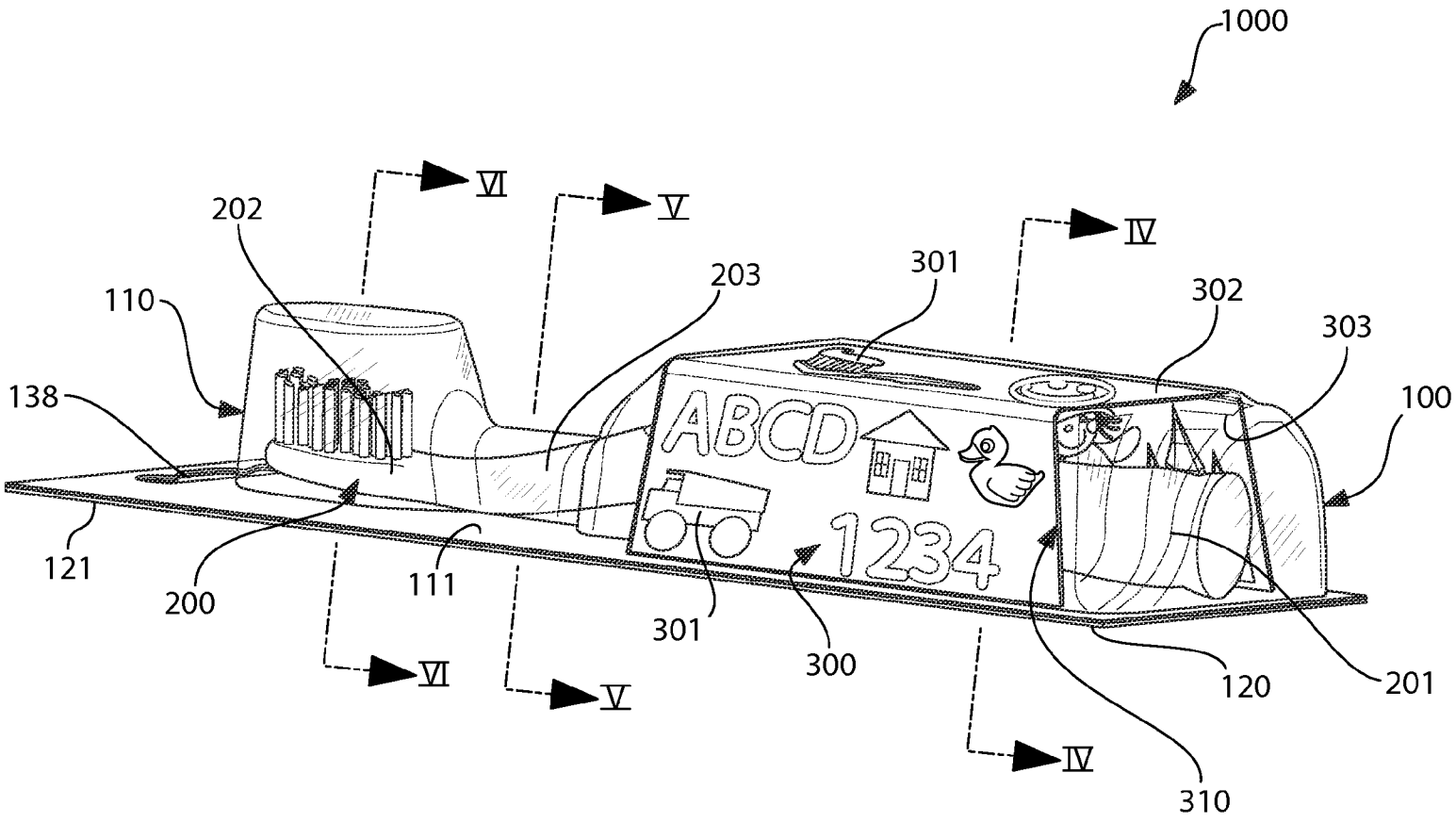
FIG. 1 is a perspective view of an oral care kit according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
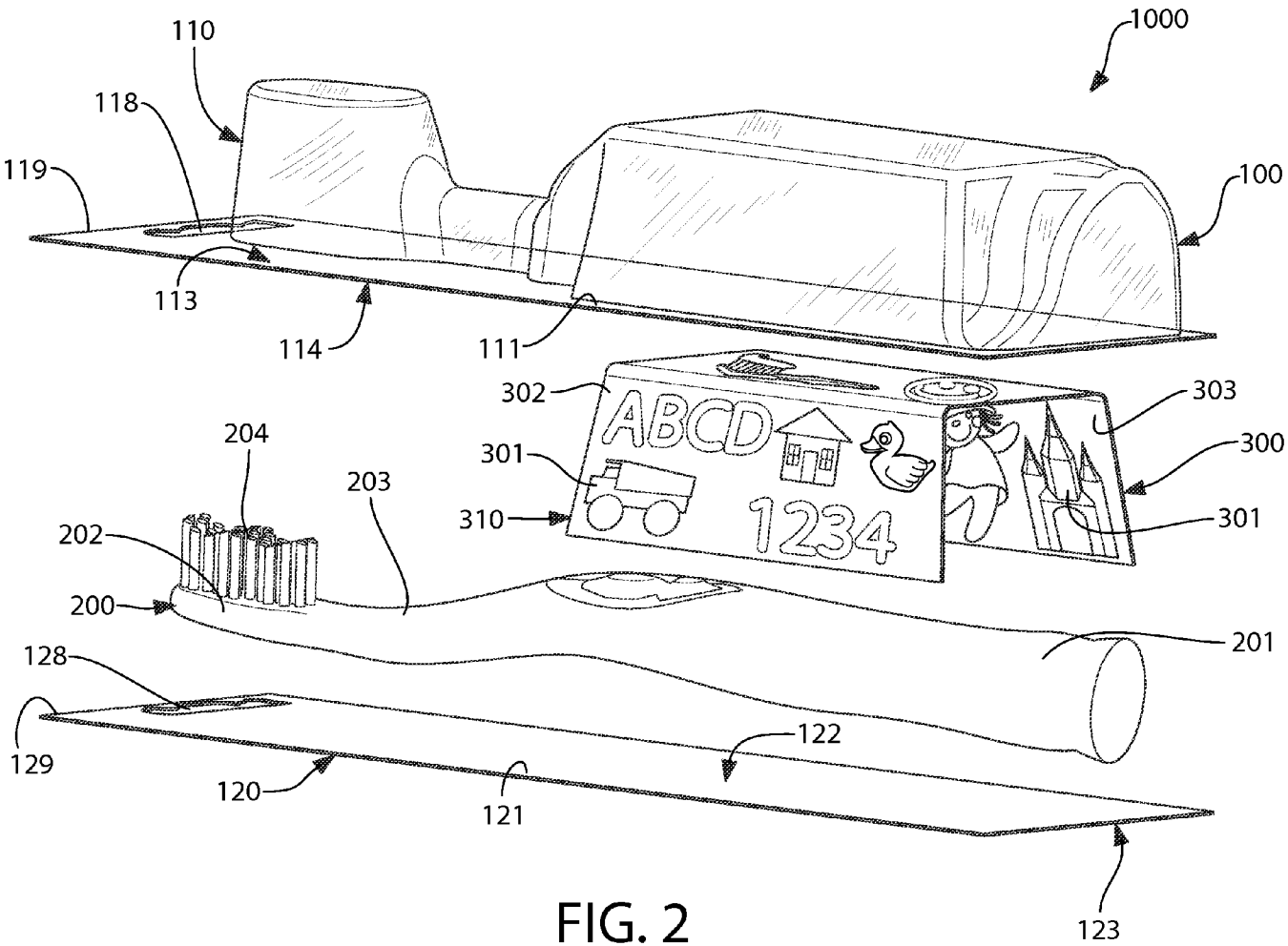
FIG. 2 is an exploded view of the oral care kit of FIG. 1.

Referring now to FIGS. 1-2 concurrently, an oral care kit 1000 is illustrated according to one embodiment of the present invention. The oral care kit 1000 generally comprises a package 100, a toothbrush 200 and a sticker panel 300. The toothbrush 200 and the sticker panel 300 are disposed within the package 100. In the exemplified embodiment, the entirety of the toothbrush 200 and the sticker panel 300 are disposed in the package 100 such that the toothbrush 200 and the sticker panel 300 are sealed therein. However, in alternate embodiments, only a portion of the toothbrush 200 may be disposed within the package 100 while another portion of the toothbrush 200 protrudes therefrom.

When the oral care kit 1000 is assembled for retail display (as shown in FIG. 1), at least a portion of the toothbrush 200 and a portion of the sticker panel 300 are visible through a transparent portion of the package 100. As a result, a potential consumer may readily identify the existence, contents and aesthetics of both the toothbrush 200 and the sticker panel 300 while the toothbrush 200 and the sticker panel 300 remain sealed in the package 100. This allows the consumer to properly evaluate the contents of the oral care kit 1000 at the point of sale.

The package 100 may take on a wide variety of embodiments and may be of a wide variety of packaging types as is known in the art. In the exemplified embodiment, the package 100 is a blister package. The package 100 generally comprises a substantially transparent three-dimensional front cover 110 and a rear cover 120. The three-dimensional front cover 110, in one embodiment, is a thermoformed plastic film. Suitable thermoformed plastic films may be constructed of such material as polyethyleneterephtalate (PETA, PETG, PETGAG), polyvinylchloride (PVC), polypropylene (PP) or styrol-butadiene-blockcopolymer (SBS), preferred PVC. Other suitable materials of construction for the thermoformed plastic film include, without limitation, renewable primary products, for example of cornstarch, sugar (polyhydroxybutyrat/-valerat), cellulose diacetat, cellulose nitrate, polyactid (PLA), and polyhydroxybutyrat (PHB). The rear cover 120 may be a single layer panel or a multi-layer laminate panel. In one embodiment, the rear cover 120 comprises a paperboard but may be formed of a wide variety of materials and combinations of materials, including thermoplastics.

The three-dimensional front cover 110 is contoured to form a receiving cavity 115 (FIGS. 4-6) into which at least a portion of the toothbrush 200 and sticker panel 300 are disposed. In one embodiment, the three-dimensional front cover 110 is contoured to resemble the general shape of the oral care product that is to be disposed therein, which in the exemplified embodiment is the toothbrush 200. In alternate embodiments, a front cover may be used that is not three-dimensionally contoured if desired. In the exemplified embodiment, the three-dimensional front cover 110 comprises a perimeter portion 111. The perimeter portion 111 of the three-dimensional front cover 110 extends from and circumferentially surrounds the contoured portion of the three-dimensional front cover 110. The perimeter portion 111 of the three-dimensional front cover 110 is substantially planar, comprising a planar top surface 113 and a planar bottom surface 114. The planar bottom surface 114 provides a flat surface for attachment of the rear cover 120 to the three-dimensional front cover 110 for securing an oral care product (such as the toothbrush 200) and the sticker panel 300 within the receiving cavity 115 as will be described below.

The rear cover 120, in the exemplified embodiment, is a substantially planar panel comprising a planar top surface 122 and a planar bottom surface 123. Of course, in other embodiments, the rear cover 120 may also be three-dimensionally contoured. In certain alternate embodiments in which the rear cover 120 is three-dimensionally contoured, the rear cover 120 may comprise a receiving cavity in which a portion of the toothbrush 200 and/or a portion of the sticker panel 300 are disposed. The rear cover 120, in such an embodiment, may be a thermoformed plastic, similar to the front cover 110 discussed above, which may or may not be transparent.

The three-dimensional front cover 110 is coupled to the rear cover 120 so as to enclose the receiving cavity 115, thereby sealing the toothbrush 200 and sticker panel 300 therein. Similar to the front cover 110, the rear cover 120 comprises a perimeter portion 121, which is a portion of the rear cover 120 that extends along the periphery of the rear cover 120. In the exemplified embodiment, the perimeter portion 111 of the three-dimensional front cover 110 is coupled to the perimeter portion 121 of the rear cover 120 (best shown in FIGS. 4-6). More specifically, the planar bottom surface 114 of the perimeter portion 111 of the three-dimensional front cover 110 is coupled to the planar top surface 122 of the rear cover 120 along the perimeter portions 111, 121. The coupling between the three-dimensional front cover 110 and the rear cover 120 may be achieved using an adhesive, thermal welding, staples or other techniques known in the art.

The three-dimensional front cover 110 has an aperture 118 at a top end 119 thereof. The rear cover 120 also has a corresponding aperture 128 at a top end 129 thereof. The positioning of the aperture 118 on the three-dimensional front cover 110 spatially corresponds with the positioning of the aperture 128 on the rear cover 120. Thus, when the three-dimensional front cover 110 is coupled to the rear cover 120 as discussed above, the apertures 118, 128 are aligned so as to form a combined aperture 138 that forms a passageway through the package 100. The combined aperture 138 may be used for hanging the oral care kit 1000 for display in a retail store.

In some embodiments of the package 100, the rear cover 120 may be a product information panel. In such embodiments, the rear cover 120 comprises indicia that provide information to a consumer about the toothbrush 200 (or other oral care product disposed within the package 100) and/or the sticker panel 300. The indicia on the rear cover 120 may include instructions, logos, advertisements, and/or other marketing information. In certain other embodiments, the rear cover 120 may be blank and/or substantially transparent as desired.

In other embodiments, the oral care kit 1000 may include a separate product information panel that is a separate component than the rear cover 120. In such embodiments, the product information panel would be positioned between the three-dimensional front cover 110 and the rear cover 120. Alternatively, the product information panel may be disposed within the receiving cavity 115 between the toothbrush 200 and the top surface 122 of the rear cover 120 or at any other location within the cavity 115. In embodiments that have a product information panel that is a separate component than that of the rear cover 120, the rear cover 120 may be formed of the same material as the three-dimensional front cover 110 and coupled thereto as is known in the art. Moreover, as discussed above, in certain such embodiments, the rear cover 120 may also be three-dimensionally contoured and comprise a receiving cavity that receives a portion of the subject oral care product, such as the toothbrush 200. If a separate product information panel is included, the toothbrush 200 may pass through an aperture in the product information panel so as to extend from the receiving cavity of the front cover 110 to the receiving cavity in the rear cover 120. Further, in some embodiments, a portion of the rear cover 120 may be transparent and the product information panel may be visible through the transparent portion of the rear cover 120.

In the exemplified embodiment, the entirety of the three-dimensional front cover 110 is substantially transparent, thereby allowing the substantial entireties of the toothbrush 200 and the sticker panel 300 to be visible from outside of the package 100 through the three-dimensional front cover 110. However, in other embodiments, only a portion of the three-dimensional front cover 110 may be substantially transparent so as to form a window. In embodiments where only a portion of the three-dimensional front cover 110 is substantially transparent, the substantially transparent portion will be aligned with the sticker panel 300 so that the at least some of the stickers 301 are visible therethrough. In such an embodiment, one portion of the three-dimensional front cover 110 is substantially transparent and aligned with the sticker panel 300 and another portion of the three-dimensional front cover 110 is substantially transparent and aligned with the head of the toothbrush 200. This embodiment enables a consumer to see the sticker panel 300 as well as to evaluate the tooth cleaning element block of the toothbrush 200 in order to determine whether the toothbrush 200, without any regard to the sticker panel 300, is one which the consumer will find enjoyable and effective to use. As used herein, the term "transparent" includes materials that allow a user to see through the material, even if the material is colored or includes a degree of translucency.

As discussed above, the toothbrush 200 is disposed within the package 100. In the exemplified embodiment, the toothbrush 200 is an electric toothbrush. However, the invention is not so limited and in certain other embodiments the toothbrush 200 may be a manual toothbrush. Furthermore, it should be understood that the oral care kit 1000 is not limited to a kit including a toothbrush positioned therein. In certain other embodiments, any type of oral care product may be included in the kit including, without limitation, a flossing implement, an interdental device, a tissue cleansing device, a tongue scraper, or the like.

In the exemplified embodiment, the toothbrush 200 comprises a handle 201, a head 202 and a neck 203 extending between the handle 201 and the head 202. The handle 201, the head 202 and the neck 203 of the toothbrush 200 are preferably constructed of a material having a suitable rigidity for handing of the toothbrush 200. Suitable materials include hard plastics, such as polyethylene, polypropylene (PP), polyamide, polyester, cellulosics, SAN, acrylic, ABS or any other of the commonly known thermoplastics used in toothbrush manufacture.

The head 202 of the toothbrush 200 comprises a plurality of tooth cleaning elements 204 extending outwardly therefrom. If desired, the head 202 of the toothbrush 200 may also comprise additional structures for oral cleaning, such as an elastomeric soft tissue cleanser. An example of a suitable elastomeric soft tissue cleanser is disclosed in U.S. Pat. No. 7,143,462, issued Dec. 5, 2006 to the assignee of the present application, the entirety of which is hereby incorporated by reference. The tooth cleaning elements 204 are generically illustrated herein as a plurality of tufts of bristles. However, the invention is in no way limited by the configuration or material of the tooth cleaning elements 204. Furthermore, while the plurality of tooth cleaning elements 204 are particularly suited for brushing and/or polishing teeth, the plurality of tooth cleaning elements 204 may also be used to clean oral soft tissue, such as a tongue, gums, or cheeks instead of or in addition to teeth.

Referring now to FIGS. 2 and 3A-3C concurrently, an embodiment of the sticker panel 300 of the oral care kit 1000 is exemplified. The sticker panel 300 comprises a front surface 302 and a rear surface 303. The sticker panel 300 further comprises a plurality of detachable stickers 301 that may be peeled off of the sticker panel 300 and applied to a desired surface, such as the toothbrush 200, by the user. In the exemplified embodiment, the sticker panel 300 comprises stickers 301 on both the front and rear surfaces 302, 303 of the sticker panel 300. However, in certain other embodiments, stickers 301 may be provided on only one of the surfaces 302, 303 of the sticker panel 300 as desired.

In the exemplified embodiment, the sticker panel 300 comprises a plurality of different stickers 301 representing different animals, automobiles, letters, smiley faces, stars, dolls and other graphic designs and the like. Of course, the invention is not to be limited by the particular design or features of the stickers 301 themselves and any shape or design may be used for the stickers 301 on the sticker panel 300. For example, in certain embodiments the sticker panel 300 may include only stickers that represent numbers. In other embodiments the sticker panel 300 may include only stickers that represent letters. In still other embodiments, the sticker panel 300 may include only stickers that represent animals. In some embodiments, the sticker panel 300 may include stickers that are two-dimensional and/or stickers that are three-dimensional. Any combination of any type of sticker may be used with the present invention.

In the exemplified embodiment, the sticker panel 300 (in its blank form) is a rectangular shaped panel. Of course, the invention is not so limited and the sticker panel 300 may take on any other shape as would be known to persons skilled in the art. As discussed below, the sticker panel 300 comprises a plurality of panel sections such that at least a portion of each of the panel sections is visible through the three-dimensional front cover 110. Alternatively, the sticker panel 300 may contain a single, unfolded panel that is visible through the three-dimensional front cover 110 as will be described in more detail below.

The stickers 301 may be peeled off of a backer panel 304 of the sticker panel 300 as is known in the art. The stickers 301 include a suitable adhesive 305 applied to their rear surfaces so that the stickers 301 may be peeled from the backer panel 304 and reapplied to another surface as desired. The sticker panel 300 is a multi-layered laminate as is known in the art. In certain embodiments, the sticker panel 300 is constructed to be sufficiently rigid so that it may be folded into different self-supporting geometries.

In the exemplified embodiment, the sticker panel 300 comprises three panel sections, including a first panel section 306, a second panel section 307 and a third panel section 308, arranged in a non-coplanar arrangement. In preferred embodiments, a front surface of each of the panel sections 306-308 is visible through the three-dimensional front cover 110 when the kit is assembled for retail display (FIG. 1). In the exemplary embodiment, each of the panel sections 306-308 comprises at least one of the stickers 301 that are visible through the substantially transparent three-dimensional front cover 110. In certain embodiments, one of the panel sections 306-308 may comprises at least one of the stickers 301, another one of the panel sections 306-308 may include product information, and the other one of the panel sections 306-308 may include marketing information. It is contemplated that each of the panel sections 306-308 may include various information and/or stickers 301. Each of the panel sections 306-308 are separated form one another by a seam 309A, 309B. The seams 309A, 309B may be pre-weakened portions of the sticker panel 300 or may be formed by mere folding of the sticker panel 300.

Figure 3A:
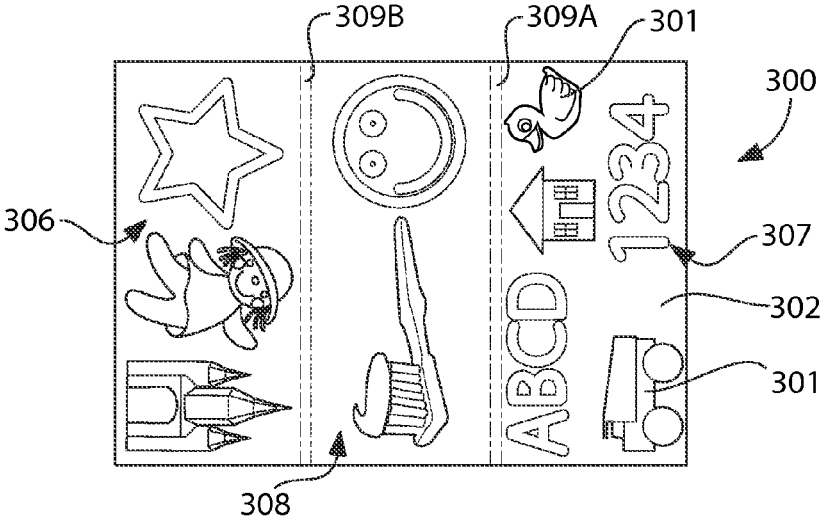
FIG. 3A is a plan view of the sticker panel for incorporation into the oral care kit of FIG. 1 in an un-folded state according to a first embodiment of the present invention.
Figure 3B:
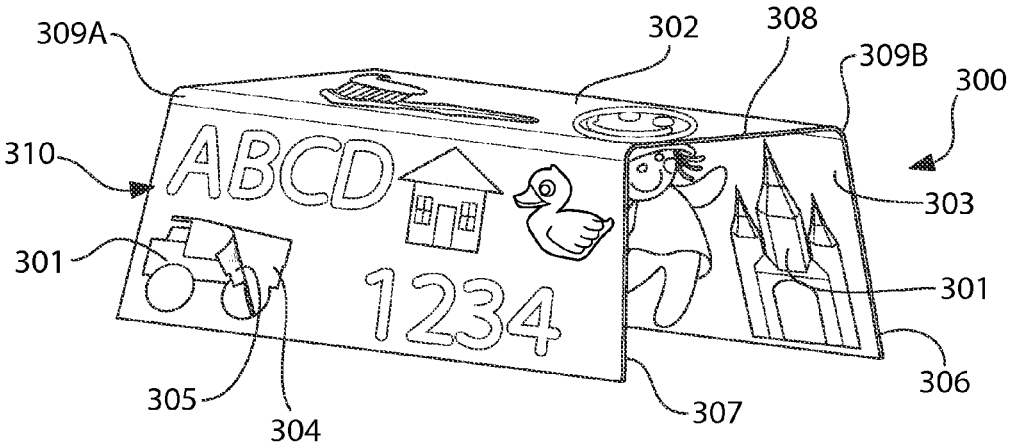
FIG. 3B is an isometric view of the sticker panel of FIG. 3A in a folded state.
Figure 3C:
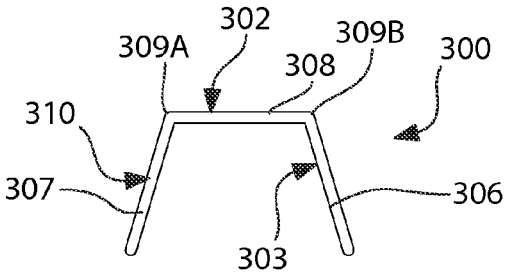
FIG. 3C is a transverse view of the sticker panel of FIG. 3A in the folded state.

When assembled within the oral care kit 1000 as illustrated in FIG. 1, the panel sections 306-308 of the sticker panel 300 are arranged in a non-coplanar arrangement with respect to one another (FIGS. 3B-3C). In the exemplified embodiment, the panel sections 306-308 are in a non-coplanar arrangement that forms a generally U-shape (viewed along the transverse cross-section of the sticker panel 300). As discussed in greater detail below, the sticker panel 300 forms a sleeve 310 through which a portion of the toothbrush 200 extends. Furthermore, by folding the sticker panel 300 into the panel sections 306-308, at least a portion of each one of the panel sections 306-308 is visible through the substantially transparent three-dimensional front cover 110. In some embodiments, the sleeve 310 is independent and separate from the toothbrush 200. In these embodiments, stickers 301 may be removed from the sticker panel 300 and applied to the toothbrush 200. In other embodiments, the sleeve 310 is integral with a portion of the toothbrush 200. In these embodiments, the sticker panel 300 may be wrapped around a portion of the toothbrush.

Referring to FIGS. 1, 2 and 4-6, the kit 1000 will be described in more detail. In the exemplified embodiment, when the kit 1000 is fully assembled and the perimeter portion 111 of the three-dimensional front cover 110 is coupled to the perimeter portion 121 of the rear cover 120, the toothbrush 200 is positioned adjacent to the front surface 121 of the rear cover 120 and the handle 201 of the toothbrush 200 extends through the sleeve 310 formed by the folded sticker panel 300. The receiving cavity 115 may be conceptually separated into three separate portions including a proximal portion 115A, a middle portion 115B and a distal portion 115C. At least a portion of the handle 201 is disposed within the proximal portion 115A of the receiving cavity 115. Furthermore, at least a portion of the head 202 is disposed within the distal portion 115C of the receiving cavity 115. As such, the neck 203 of the toothbrush 200 is disposed within the middle portion 115B of the receiving cavity 115.

In the exemplified embodiment, the sticker panel 300 is disposed within the package 100 in the proximal portion 115A of the receiving cavity 115. Thus, the sticker panel 300 covers or surrounds at least a portion of the handle 201 of the toothbrush 200 and the stickers 301 on the sticker panel 300 are visible to a user from outside of the package 100 through the proximal portion 115A. More specifically, the handle 201 of the toothbrush 200 extends through the sleeve 310 formed by the sticker panel 300. While the handle 201 extends through the sleeve 310 of the sticker panel 300, at least a portion of the toothbrush 200 (or other oral care product) protrudes from the sleeve 310 so as to be visible from outside of the package 100 as has been described above.

It should be understood that the invention is not limited to the sticker panel 300 being disposed within the proximal portion 115A of the receiving cavity 115 and in certain other embodiments the sticker panel 300 may be disposed in either the middle portion 115B and/or the distal portion 115C of the receiving cavity 115. In such embodiments, the sticker panel 300 will be disposed within the middle and distal portions 115B, 115C of the receiving cavity 115 in the same manner as will be described below with regard to the sticker panel 300 being disposed within the proximal portion 115A of the receiving cavity 115. In embodiments having the sticker panel 300 disposed in the middle portion 115B of the receiving cavity 115, the neck 203 of the toothbrush 200 will extend through the sleeve 310 of the sticker panel 300. In embodiments having the sticker panel 300 disposed in the distal portion 115C of the receiving cavity 115, the head 202 of the toothbrush 200 will extend through the sleeve 310 of the sticker panel 300. Regardless of the positioning of the sticker panel 300 relative to the toothbrush 200, it is preferable that at least a portion of the toothbrush 200 protrude from the sleeve so as to be visible from outside of the package 100. Furthermore, regardless of the positioning of the sticker panel 300 in the receiving cavity 115, at least a portion of each of the panel sections 306-308 will be visible from outside of the package 100 through the three-dimensional front cover 110.

Additionally, in certain other embodiments, additional stickers or sticker panels may be disposed within the cavity 115 that are separate from the sticker panel 300. The additional stickers may either be disposed in the cavity 115 so as to be visible from outside of the package 100 or they may be positioned in such a manner that they are only visible after the package 100 has been opened. For example, in some embodiments, a sticker panel may be disposed in one or more of the proximal portion 115A, the middle portion 115B and the distal portion 115C. Further, in certain embodiments, sticker panel 300 is separate and independent from the package 100. In other embodiments, sticker panel 300 is integral with an inner surface of the package 100.

Figure 4:
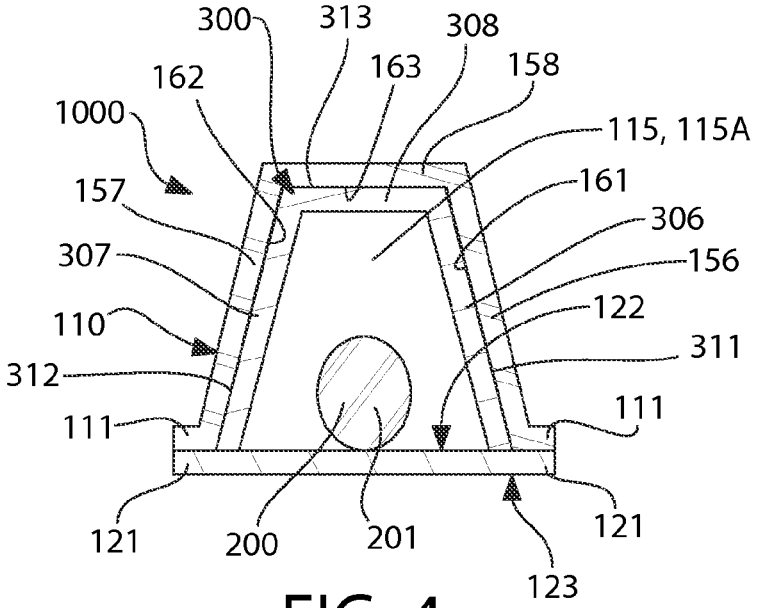
FIG. 4 is a transverse cross-sectional view of the oral care kit of FIG. 1 taken along view IV-IV.
Figure 5:
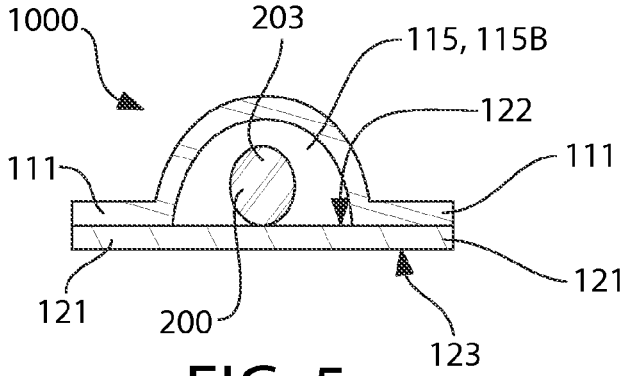
FIG. 5 is a transverse cross-sectional view of the oral care kit of FIG. 1 taken along view V-V.
Figure 6:
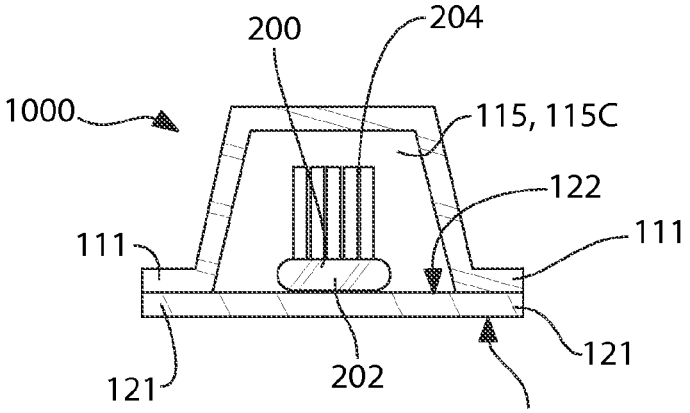
FIG. 6 is a transverse cross-sectional view of the oral care kit of FIG. 1 taken along view VI-VI.

Referring now to FIGS. 4-6 concurrently, the various portions of the receiving cavity 115 will be described in more detail. The middle portion 115B of the receiving cavity 115 is narrow relative to the proximal and distal portions 115A, 115C of the receiving cavity 115. Stated another way, the middle portion 115B of the receiving cavity 115 has a transverse cross-sectional area that is smaller than (or reduced relative to) the transverse cross-sectional areas of the proximal and distal portions 115A, 115C of the receiving cavity 115. The middle portion 115B of the receiving cavity 115 may be narrower because the middle portion 115B is intended to house the neck 203 of the toothbrush 200, and the neck 203 of the toothbrush 200 is narrow relative to the handle 201 and the head 202 of the toothbrush 200. Thus, as mentioned above, the various portions of the receiving cavity 115 are sized and configured to accommodate the oral care product, such as the toothbrush 200, therein.

As discussed above, the sticker panel 300 comprises the first panel section 306, the second panel section 307 and the third panel section 308. At least two of the panel sections 306-308 extend outward from the front surface 122 of the rear cover 120, thereby forming upstanding walls In the exemplified embodiment, the first panel section 306 and the second panel section 307 are in contact with and extend outward from the front surface 122 of the rear cover 120.

As noted above, the sticker panel 300 has a front surface 302 and a rear surface 303. The front surface 302 of the sticker panel 300 may be conceptually divided into three separate front surfaces, each corresponding to one of the panel sections 306-308 of the sticker panel 300. Thus, the first panel section 306 has a front surface 311, the second panel section 307 has a front surface 312 and the third panel section 308 has a front surface 313. Furthermore, the three-dimensional front cover 110 has walls that correspond with the first, second and third panel sections 306-308 of the sticker panel 300. Specifically, the three-dimensional front cover 110 has a first wall section 156, a second wall section 157 and a third wall section 158. The first wall section 156 has a rear surface 161, the second wall section 157 has a rear surface 162 and the third wall section 158 has a rear surface 163. Both the three-dimensional front cover 110 and the sticker panel 300 conceptually form upstanding walls relative to the front surface 122 of the rear cover 120.

In the exemplified embodiment, the front surface 311 of the first panel section 306 of the sticker panel 300 is in surface contact with the rear surface 161 of the first wall section 156 of the three-dimensional front cover 110. Furthermore, the front surface 312 of the second panel section 307 of the sticker panel 300 is in surface contact with the rear surface 162 of the second wall section 157 of the three-dimensional front cover 110. Additionally, the front surface 313 of the third panel section 308 of the sticker panel 300 is in surface contact with the rear surface 163 of the third wall section 158 of the three-dimensional front cover 110. The surface contact between the wall sections 156-158 of the three-dimensional front cover 110 and corresponding panel sections 306-308 of the sticker panel 300 enables the stickers 301 of the sticker panel 300 to be readily visible through the substantially transparent three-dimensional front cover 110.

In the exemplified embodiment, the substantial entireties of the front surfaces 311-313 of the panel sections 306-308 of the sticker panel 300 are in surface contact with the entireties of the rear surfaces 161-163 of the wall sections 156-158 of the three-dimensional front cover 110. Of course, the invention is not so limited and in other embodiments less than the entireties of the front surfaces 311-313 of the panel sections 306-308 of the sticker panel 300 are in surface contact with the rear surfaces 161-163 of the wall sections 156-158 of the three-dimensional front cover 110. However, it is preferable that at least a portion of each of the panel sections 306-308 of the sticker panel 300 be in surface contact with a portion of the wall sections 156-158 of the three-dimensional front cover 110 to make the stickers 301 disposed within the cavity 115 readily visible from outside of the package 100.

As discussed above, in the exemplified embodiment the sticker panel 300 is folded or otherwise separated into panel sections 306-308, each of which is visible through one of the wall sections 156-158 of the three-dimensional front cover 110. However, in certain other embodiments the sticker panel 300 may be a single panel that is not folded or otherwise separated into panel sections. In such embodiments, the sticker panel 300 may be visible through any one of the wall sections 156-158 of the three-dimensional front cover 110. For example, the sticker panel 300 may be disposed within the cavity 115 so that it is only visible through any one of the first, second or third wall sections 156-158 of the three-dimensional front cover 110.

Figure 7A:
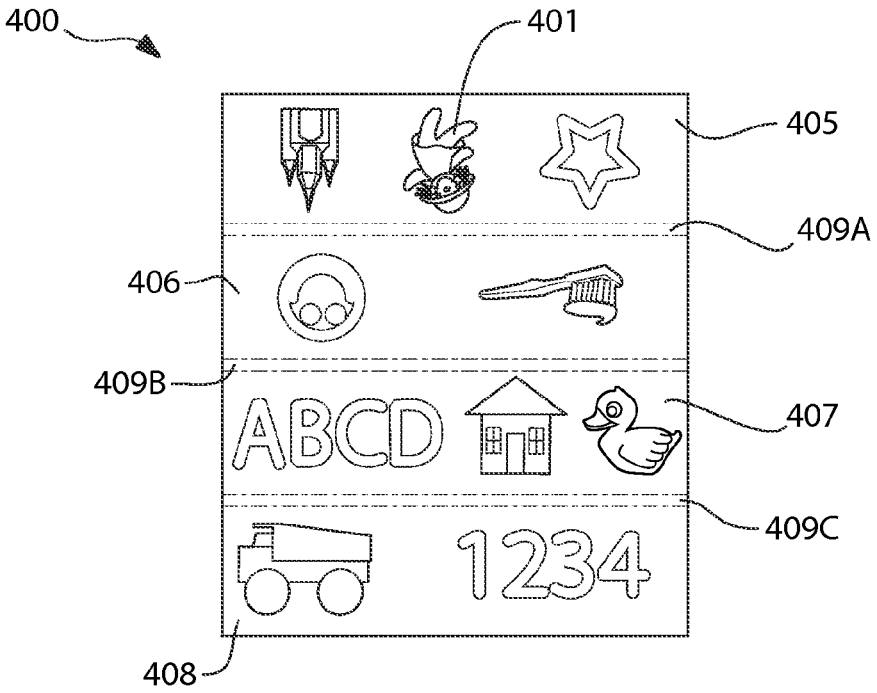
FIG. 7A is plan view of a sticker panel for incorporation into the oral care kit of FIG. 1 in an un-folded state according to a second embodiment of the present invention.
Figure 7B:
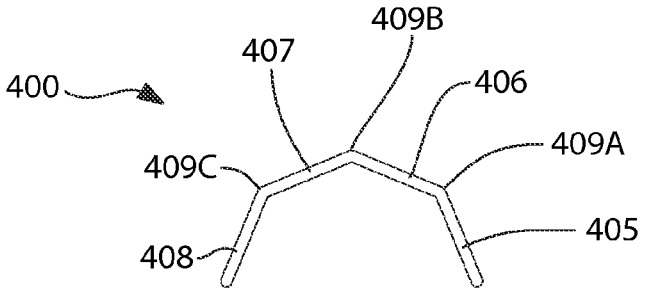
FIG. 7B is a transverse view of the sticker panel of FIG. 7A in the folded state.

While the foregoing description has referred to the kit 1000 as include three panel sections 306-308, it should be understood that sticker panels having more or less than three panel sections may be used with the present invention. Referring to FIGS. 7A and 7B, a sticker panel 400 containing a plurality of stickers 401 thereon is illustrated. The sticker panel 400 comprises four panel sections including a first panel section 405, a second panel section 406, a third panel section 407 and a fourth panel section 408. Each of the panel sections 405-408 are separated from one another by a seam 409A, 409B, 409C. As described above, the seams 409A-409C may be pre-weakened portions of the sticker panel 400 or may be formed by mere folding of the sticker panel 400. As illustrated in FIG. 7B, when the sticker panel 400 is folded at each of the seams 409A-409C, the panel sections 405-408 are in a non-coplanar arrangement that forms a general U-shape for the transverse cross-section of the sticker panel 400. However, the sticker panel 400 has four sides unlike the three sides of the sticker panel 300. Thus, the sticker panel 400 will be best suited for placement within a package that has a three-dimensional front cover with a corresponding shape. Of course, the sticker panel 400 may be used within the package 100 as would be understood by persons skilled in the art. Moreover, the sticker panel 400 may be used to form a sleeve having a closed transverse cross-sectional geometry (such as a rectangle).

Figure 8A:
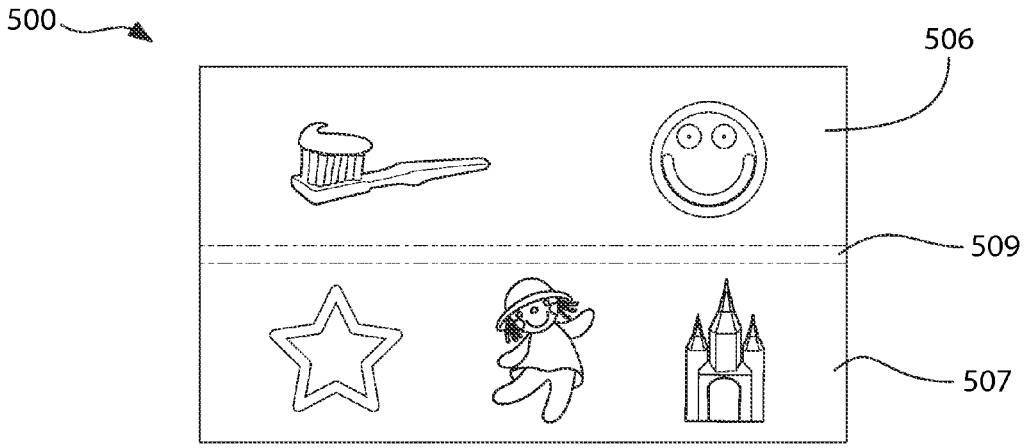
FIG. 8A is plan view of a sticker panel for incorporation into the oral care kit of FIG. 1 in an un-folded state according to a third embodiment of the present invention.
Figure 8B:
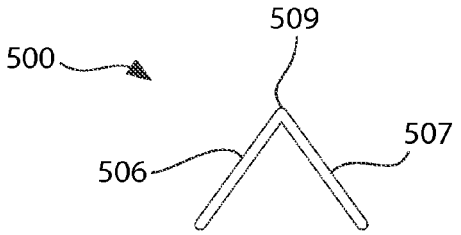
FIG. 8B is a transverse view of the sticker panel of FIG. 8A in the folded state.

Referring to FIGS. 8A and 8B, another sticker panel 500 containing a plurality of stickers 501 thereon is illustrated. The sticker panel 500 only has two panel sections including a first panel section 506 and a second panel section 507, which are separated by a single seam 509. When the sticker panel 500 is folded at the seam 509, the panel sections 506, 507 are in a non-coplanar arrangement that forms a generally triangular shape for the transverse cross-section of the sticker panel 500. The sticker panel 500 in its folded state has two sides. Thus, the sticker panel 500 is best suited for placement within a package having a three-dimensional front cover with a corresponding shape. Of course, however, the sticker panel 500 may be used within the package 100 as would be understood by persons skilled in the art. It should be understood that the number of panel sections on the sticker panels is in no way limiting of the present invention. In other words, there is no limit to the number of panel sections that a particular sticker panel being used with the present invention may have.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care kit comprising:

a package;

a toothbrush disposed within the package; and a sticker panel disposed within the package, the sticker panel comprising one or more stickers, the sticker panel forming a sleeve through which a portion of the toothbrush extends, at least one of the one or more stickers visible from outside of the package through a substantially transparent portion of the package.

2. The oral care kit according to claim 1 wherein the toothbrush is an electric toothbrush.

3. The oral care kit according to claim 1 wherein the package is a blister package, the blister package comprising a product information panel, the toothbrush positioned adjacent a front surface of the product information panel, a handle of the toothbrush extending through the sleeve formed by the sticker panel.

4. The oral care kit according to claim 1 wherein the package comprises a substantially transparent three-dimensional front cover, the three-dimensional front cover forming a receiving cavity in which at least a portion of the toothbrush and at least a portion of the sticker panel are disposed, and the at least one sticker being visible through the substantially transparent three-dimensional front cover.

5. The oral care kit according to claim 4 wherein the package comprises a rear cover, the rear cover coupled to the three-dimensional front cover to enclose the receiving cavity.

6. The oral care kit according to claim 5 wherein the rear cover is a substantially planar product information panel and comprises paperboard.

7. The oral care according to claim 5 wherein a perimeter portion of the three-dimensional front cover is coupled to a perimeter portion of the rear cover.

8. The oral care kit according to claim 4 wherein the receiving cavity comprises a proximal portion in which at least a portion of a handle of the toothbrush is disposed and a distal portion in which at least a portion of a head of the toothbrush is disposed.

9. The oral care kit according to claim 8 wherein the sticker panel is disposed within the proximal portion, the handle of the toothbrush extending through the sleeve formed by the sticker panel.

10. The oral care kit according to claim 8 wherein the receiving cavity comprises a middle portion in which at least a portion of a neck of the toothbrush is disposed, the middle portion extending between the proximal and distal portions of the receiving cavity, the middle portion being narrow relative to the proximal and distal portions.

11. The oral care kit according to claim 4 wherein the sticker panel comprises a plurality of panel sections separated from one another by a seam and being non-coplanar with respect to one another, and wherein each of the panel sections comprises at least one sticker that is visible through the substantially transparent three-dimensional front cover.

12. The oral care kit according to claim 11 wherein the sticker panel comprises a first panel section, a second panel section and a third panel section, a front surface of each of the first, second and third panel sections being positioned in surface contact with a corresponding wall of the three-dimensional front cover.

13. The oral care kit according to claim 4 wherein the three-dimensional front cover is a thermoformed plastic film.

14. The oral care kit according to claim 1 wherein the entirety of the toothbrush and the entirety of the sticker panel are disposed within the package.

15. The oral care kit according to claim 1 wherein at least a portion of the toothbrush protrudes from the sleeve formed by the sticker panel and is visible from outside of the package.

16. The oral care kit according to claim 1 wherein the sticker panel is separate and independent from the package.

17. The oral care kit according to claim 1 wherein the one or more stickers are sized to be attached to the toothbrush.

18. An oral care kit comprising:

a blister package comprising a substantially transparent three-dimensional front cover forming a receiving cavity;

a toothbrush at least partially disposed within the receiving cavity; and a sticker panel at least partially disposed within the receiving cavity, the sticker panel comprising a plurality of detachable stickers, the sticker panel comprising a plurality of panel sections separated from one another by a seam and being non-coplanar with respect to one another, wherein a front surface of at least one of the panel sections is visible through the three-dimensional front cover, at least one front surface of the plurality of panel sections comprising at least one sticker, and wherein the sticker panel forms a sleeve through which a rear portion of the toothbrush extends.

19. The oral care kit according to claim 18 wherein a front surface of each of the panel sections is in surface contact with a corresponding wall of the three-dimensional front cover.

20. The oral care kit according to claim 18 wherein the blister package comprises an aperture at a top end of the blister package for hanging the toothbrush kit for display.

21. The oral care kit according to claim 20 wherein the sticker panel comprises at least two of the panel sections that extend outward from a rear surface of the front cover.

22. The oral care kit according to claim 18 wherein the entirety of the toothbrush and the entirety of the sticker panel are disposed within the blister package.

23. The oral care kit according to claim 18 wherein the blister package comprises a rear cover, the rear cover coupled to the three-dimensional front cover to enclose the receiving cavity.

24. An oral care kit comprising:

a package;

an oral care product disposed within the package; and a sticker panel disposed within the package, the sticker panel comprising a plurality of detachable stickers, the plurality of stickers visible from outside of the package through a substantially transparent portion of the package, and wherein the sticker panel forms a sleeve through which a portion of the oral care product extends.

25. The oral care kit according to claim 24 wherein the package comprises a rear cover and a substantially transparent three-dimensional front cover forming a receiving cavity in which at least a portion of the oral care product and at least a portion of the sticker panel are disposed.

26. The oral care kit according to claim 24 wherein the package comprises a substantially transparent three-dimensional front cover forming a receiving cavity in which at least a portion of the oral care product and at least a portion of the sticker panel are disposed, and the plurality of stickers being visible through the substantially transparent three-dimensional front cover.

27. The oral care kit according to claim 26 wherein the sticker panel comprises a plurality of panel sections separated from one another by a seam and being non-coplanar with respect to one another, and wherein a front surface of each of the panel sections is visible through the three-dimensional front cover, the front surface of each of the panel sections comprising at least one of the plurality of stickers.

28. The oral care kit according to claim 27 wherein a front surface of each of the panel sections is in surface contact with a corresponding wall of the three-dimensional front cover.

29. The oral care kit according to claim 24 wherein the oral care product is a toothbrush.

* * * * *